US005623575A

United States Patent [19]

Fette et al.

[11] Patent Number: 5,623,575

[45] Date of Patent: Apr. 22, 1997

[54] EXCITATION SYNCHRONOUS TIME ENCODING VOCODER AND METHOD

[75] Inventors: Bruce A. Fette, Mesa; Chad S. Bergstrom; Sean S. You, both of Chandler, all of Ariz.

[73] Assignee: Motorola, Inc., Schaumburg, Ill.

[21] Appl. No.: 502,990

[22] Filed: Jul. 17, 1995

Related U.S. Application Data

[62] Division of Ser. No. 68,918, May 28, 1993, Pat. No. 5,479, 559.

[51] Int. Cl.[6] ..... G10L 3/00

[52] U.S. Cl. ..... 395/2.74; 395/2.16; 395/2.23; 395/2.75

[58] Field of Search ..... 395/2.67, 2.1, 395/2.12, 2.23, 2.24, 2.25, 2.28, 2.29, 2.3–2.32, 2.26, 2.76, 2.16, 2.79, 2.74, 2.75, 2.71, 2.14; 381/38–43

[56] References Cited

U.S. PATENT DOCUMENTS

| | | | |
|---|---|---|---|
| 4,439,839 | 3/1984 | Kneib et al. | 364/900 |
| 4,710,959 | 12/1987 | Feldman et al. | 381/36 |
| 4,742,550 | 5/1988 | Fette | 381/36 |
| 4,815,134 | 3/1989 | Picone et al. | 395/2.31 |
| 4,899,385 | 2/1990 | Ketchum et al. | 395/2.32 |
| 4,963,034 | 10/1990 | Cuperman et al. | 395/2.31 |
| 4,969,192 | 11/1990 | Chen et al. | 395/2.31 |
| 5,027,404 | 6/1991 | Taguchi | 395/2.3 |
| 5,060,269 | 10/1991 | Zinser | 381/38 |
| 5,127,053 | 6/1992 | Koch | 381/31 |
| 5,138,661 | 8/1992 | Zinser et al. | 381/35 |
| 5,265,190 | 11/1993 | Yip et al. | 395/2.28 |
| 5,293,449 | 3/1994 | Tzeng | 395/2.32 |
| 5,341,456 | 8/1994 | DeJaco | 395/2.23 |
| 5,371,853 | 12/1994 | Kao et al. | 395/2.32 |
| 5,485,543 | 1/1996 | Aso | 395/2.76 |

OTHER PUBLICATIONS

Granzow et al., "High quality digital speech at 4KB/S", 1990, pp. 941–945, Globecom '90–IEEE Global Tlelecommunications Conference Dec. 1990.

Marques et al., "Improved Pitch Prediction with Fractional Delay in Celp Coding", 1990, pp. 665–668, ICASSP '90–1990 International Conference on Acoustics, Speech, and signal processing. Apr. 1990.

Nathan et al., "A Time varying analysis method for rapid transitions in speech", 1991, pp. 815–824, IEEE Transactions on Signal processing. Apr. 1991.

Wood et al., "Excitation Synchronous Formant Analysis", 1989, pp. 110–118, IEE Proceedings I [Communications, Speech and Vision] Apr. 1988.

Laroche et al., "HNS: Speech modification based on a harmonics model", ICASSP–93. 1993 IEEE International Conference on Acoustics, Speech, and Signal Processing. pp. 550–553 Apr. 1993.

(List continued on next page.)

*Primary Examiner*—Allen R. MacDonald
*Assistant Examiner*—Richemond Dorvil
*Attorney, Agent, or Firm*—Frederick M. Fliegel

[57] ABSTRACT

A method for excitation synchronous time encoding of speech signals. The method includes steps of providing an input speech signal, processing the input speech signal to characterize qualities including linear predictive coding (LPC) coefficients, epoch length and voicing and characterizing the input speech signals on a single epoch time domain basis when the input speech signals comprise voiced speech to provide a parameterized voiced excitation function. The method further includes steps of characterizing the input speech signals for at least a portion of a frame when the input speech signals comprise unvoiced speech to provide a parameterized unvoiced excitation function and encoding a composite excitation function including the parameterized unvoiced excitation function and the parameterized voiced excitation function to provide a digital output signal representing the input speech signal.

20 Claims, 5 Drawing Sheets

OTHER PUBLICATIONS

Yeldener et al., "Low bit rate speech coding at 1.2 and 2.4 kb/s", IEE colloquium on speech coding–techniques and applications, pp. 611–614. Apr. 1992.

An article entitled "Excitation–Synchronous Modeling of Voiced Speech" by S. Parthasathy and Donald W. Tufts. from IEEE Transactions on Acoustics, Speech and Signal Processing, vol. ASSP–15, No. 9, (Sep. 1987).

An article entitled "Pitch Prediction Filters In Speech Coding", by R.P. Ramachandran and P. Kabal, in IEEE Transactions on Acoustics, Speech and Signal Processing, vol. 37, No. 4. (Apr., 1989).

An article entitled "High–Quality Speech Coding at 2.4 to 4.0 KBPS Based On Time–Frequency Interpolation" by Yair Shoham, Speech Coding Research Dept., A T & T Bell Laboratories, 1993 IEEE, (1993).

An article entitled "Implementation and Evaluation of a 2400 BPS Mixed Excitation LPC Vocoder" by Alan V. McCree and Thomas P. Barnwell III, School of Electrical Engineering, Georgia Institute of Technology, (1993).

22

EXCITATION SYNCHRONOUS TIME ENCODING VOCODER AND METHOD

This is a division of application Ser. No. 08/068,918, filed on May 28, 1993, U.S. Pat. No. 5,479,559.

CROSS-REFERENCE TO RELATED APPLICATIONS

This application is related to co-pending U.S. patent application Ser. No. 07/732,977, filed on Jul. 19 of 1991 and Ser. No. 08/068,325, entitled "Pitch Epoch Synchronous Linear Predictive Coding Vocoder And Method", filed on an even date herewith, which are assigned to the same assignee as the present application.

FIELD OF THE INVENTION

This invention relates in general to the field of digitally encoded human speech, in particular to coding and decoding techniques and more particularly to high fidelity techniques for digitally encoding speech, for transmitting digitally encoded high fidelity speech signals with reduced bandwidth requirements and for synthesizing high fidelity speech signals from digital codes.

BACKGROUND OF THE INVENTION

Digital encoding of speech signals and/or decoding of digital signals no provide intelligible speech signals are important for many electronic produces providing secure communications capabilities, communications via digital links or speech output signals derived from computer instructions.

Many digital voice systems suffer from poor perceptual quality in the synthesized speech. Insufficient characterization of input speech basis elements, bandwidth limitations and subsequent reconstruction of synthesized speech signals from encoded digital representations all contribute to perceptual degradation of synthesized speech quality. Moreover, some information carrying capacity is lost; the nuances, intonations and emphases imparted by the speaker carry subtle but significant messages lost in varying degrees through corruption in en- and subsequent de-coding of speech signals transmitted in digital form.

In particular, auto-regressive linear predictive coding (LPC) techniques comprise a system transfer function having all poles and no zeroes. These prior art coding techniques and especially those utilizing linear predictive coding analysis tend to neglect all resonance contributions from the nasal cavities (which essentially provide the "zeroes" in the transfer function describing the human speech apparatus) and result in reproduced speech having an artificially "tinny" or "nasal" quality.

Standard techniques for digitally encoding and decoding speech generally utilize signal processing analysis techniques having substantial computational complexity. Further, digital signals resultant therefrom require significant bandwidth in realizing high quality real-time communication.

What are needed are apparatus and methods for rapidly and accurately characterizing speech signals in a fashion lending itself to digital representation thereof as well as synthesis methods and apparatus for providing speech signals from digital representations which provide high fidelity while conserving digital bandwidth and which reduce both computation complexity and power requirements.

SUMMARY OF THE INVENTION

Briefly stated, there is provided a new and improved apparatus for digital speech representation and reconstruction and a method therefor.

In a first preferred embodiment, the present invention comprises a method for excitation synchronous time encoding of speech signals. The method includes steps of providing an input speech signal, processing the input speech signal to characterize qualities including linear predictive coding coefficients, epoch length and voicing, and, when input speech comprises voiced speech, characterizing the input speech on a single-epoch basis to provide single-epoch speech parameters and encoding the single-epoch speech parameters using a vector quantizer codebook to provide digital signals representing voiced speech.

In a second preferred embodiment, the present invention comprises a method for excitation synchronous time decoding of digital signals to provide speech signals. The method includes steps of providing an input digital signal representing speech and determining when the input digital signal represents voiced speech. The method performs steps of interpolating linear predictive coding parameters, reconstructing a voiced excitation function and synthesizing speech from the reconstructed voiced excitation function by providing the reconstructed voiced excitation function to a lattice synthesis filter.

When the input digital data represent unvoiced speech, the method desirably but not essentially includes steps of decoding a series of contiguous root-mean-square (RMS) amplitudes and modulating a noise generator with an excitation envelope derived from the series of contiguous RMS amplitudes to provide synthesized unvoiced speech from the reconstructed unvoiced excitation function.

In another preferred embodiment, the present invention includes an apparatus for excitation synchronous time encoding of speech signals. The apparatus comprises a frame synchronous linear predictive coding (LPC) device having an input and an output. The input accepts input speech signals and the output provides a first group of LPC coefficients describing a first portion of the input speech signal and an excitation function describing a second portion of the input speech signal. The apparatus also includes an autocorrelator for estimating an epoch length of the excitation waveform and a pitch filter. The pitch filter has an input coupled to the autocorrelator and an output signal comprising three coefficients describing pitch characteristics of the excitation waveform. The apparatus also includes a frame voicing decision device coupled to an output of the pitch filter, the output of the correlator and the output of the frame synchronous LPC device. The frame voicing decision device determines whether a frame is voiced or unvoiced. The apparatus also includes apparatus for computing representative signal levels in a series of contiguous time slots comprising a frame length. The apparatus for computing representative signal levels is coupled to the frame voicing decision device and operates when the frame voicing decision device indicates that the frame is unvoiced. The apparatus also includes vector quantizer codebooks coupled to the apparatus for computing representative signal levels. The vector quantizer codebooks provide a vector quarantined digital signal corresponding to the input speech signal.

The apparatus desirably but not essentially includes an apparatus for determining epoch excitation positions within a frame of speech data. The determining apparatus is coupled to the frame voicing decision apparatus and operates when the frame voicing decision apparatus determines that a frame is voiced. A second linear predictive coding apparatus has a first input for accepting input speech signals and a second input coupled to the apparatus for determining epoch excitation positions. The second LPC apparatus characterizes the input speech signals to provide (1) a second group of LPC coefficients describing a first portion of the input speech signals and (2) a second excitation function describing a second portion of the input speech signals. The second group of LPC coefficients and the second excitation function comprise single-epoch speech parameters. The apparatus further includes an apparatus for selecting an interpolation excitation target from within a portion of the second excitation function based on minimum envelope error to provide a target excitation function. An input of the interpolation excitation target selecting apparatus is coupled to the second LPC apparatus. The apparatus for selecting has an output coupled to the encoding apparatus.

The apparatus further desirably but not essentially includes first through fifth decision apparatus for setting first through fifth voicing flags. The first decision apparatus sets a first voicing flag to "voiced" when a linear predictive gain coefficient from the first group of LPC coefficients exceeds or is equal to a first threshold and sets the first voicing flag to "unvoiced" otherwise. The second decision apparatus sets a second voicing flag to "voiced" when either a second of the multiplicity of coefficients exceeds or is equal to a second threshold or a pitch gain of the pitch filter exceeds or is equal to a third threshold and sets the second voicing flag to "unvoiced" otherwise. The third decision apparatus sets a third voicing flag to "voiced" when the second of the multiplicity of coefficients exceeds or is equal to the second threshold and a linear predictive coding gain exceeds or is equal to a fourth threshold and sets the third voicing flag to "unvoiced" otherwise. The fourth decision apparatus sets a fourth voicing flag to "voiced" when the linear predictive coding gain exceeds or is equal to a fourth threshold and the pitch gain exceeds or is equal to the third threshold and sets the fourth voicing flag to "unvoiced" otherwise. The fifth decision apparatus sets a fifth voicing flag to "voiced", when any of the first, second, third and fourth voicing flags is set to "voiced", when the linear predictive coding gain is not less than a fifth threshold and the second of the multiplicity of coefficients is not less than a sixth threshold and sets the fourth voicing flag to "unvoiced" otherwise. The frame is determined to be voiced when any of the first, second, third and fourth voicing flags is set to "voiced" and the fifth voicing flag is set to voiced. The frame is determined to be unvoiced when all of the first, second, third and fourth voicing flags are set to "unvoiced" The frame is determined to be unvoiced when the fifth voicing flag is determined to be set to "unvoiced".

In a further embodiment, the apparatus desirably but not essentially includes apparatus for selecting excitation weighting coupled to the apparatus for selecting an interpolation excitation target. The apparatus for selecting excitation weighting provides a weighting function from a first class of weighting functions comprising Rayleigh type weighting functions for a first type of excitation typical of male speech and provides a weighting function from a second class of weighting functions comprising Gaussian type weighting functions for a second type of excitation having a higher pitch than the first type of excitation. The second type of excitation is typical of female speech. An apparatus for weighting the target excitation function with the weighting function provides an output signal to the encoding apparatus. The weighting apparatus is coupled to the apparatus for selecting excitation weighting.

In a further preferred embodiment, the present invention includes an apparatus for excitation synchronous time decoding of digital signals to provide speech signals. The apparatus comprises an input for receiving digital signals representing encoded speech and vector quantizer codebooks coupled to the input. The vector quantizer codebooks provide quantized signals from the digital signals. A frame voicing decision apparatus is coupled to the vector quantizer codebooks. The frame voicing decision apparatus determines when the quantized signals represent voiced speech and when the quantized signals represent unvoiced speech. An apparatus for interpolating between contiguous levels representative of unvoiced excitation is coupled to the frame voicing decision apparatus. A random noise generator is coupled to the interpolation apparatus. The random noise generator provides noise signals amplitude modulated in response to signals from the interpolation apparatus. A lattice synthesis filter is coupled to the random noise generator and synthesizes unvoiced speech from the amplitude modulated noise signals.

The apparatus desirably but not essentially includes a linear predictive coding (LPC) parameter interpolation device coupled to the frame voicing decision device. The LPC parameter interpoiation device interpolates between successive LPC parameters provided in the quantized signals when the quantized signals represent voiced speech to provide interpolated LPC parameters and a lattice synthesis filter device is coupled to the LPC parameter interpolation device for synthesizing voiced speech from the quantized signals and the interpolated LPC parameters.

The apparatus desirably but not essentially further includes a device for inerpolating successive excitation functions intercalated between target excitation functions. The device for interpolating successive excitation functions has an input coupled to the LPC parameter interpolation device and has an output coupled to said lattice synthesis filter device. The device for interpolating between target excitation functions interpolates between target excitation functions in epochs between a first target epoch in a first frame and a second target epoch in a second frame adjacent the first frame. The lattice synthesis filter device synthesizes voiced speech from the interpolated LPC parameters and the interpolated successive excitation functions.

Another preferred embodiment of the present invention is a communications apparatus including an input for receiving input speech signals, a speech digitizer coupled to the input for digitally encoding the input speech signals and an output for transmitting the digitally encoded input speech signals. The output is coupled to the speech digitizer. A digital input receives digitally encoded speech signals and is coupled to a speech synthesizer, which synthesizes speech signals from the digitally encoded speech signals. The speech synthesizer includes a frame voicing decision device coupled to vector quantizer codebooks. The frame voicing decision device determines when intermediate signals from the vector quantizer codebooks represent voiced speech and when the intermediate signals represent unvoiced speech. A device for interpolating between contiguous signal levels representative of unvoiced speech is coupled to the frame voicing decision device. A random noise generator is coupled to the interpolating device. The random noise generator provides noise signals modulated to a level determined by the interpolating device. An output is coupled to the random noise generator which synthesizes unvoiced speech from the modulated noise signals.

The communications apparatus desirably but not essentially includes a Gaussian random number generator.

A third preferred embodiment of the present invention includes a method for excitation synchronous time encoding of speech signals. The method includes steps of providing an input speech signal, processing the input signal to characterize qualities including linear predictive coefficients, epoch length and voicing. When input signals comprise voiced speech, the input speech signals are characterized on a single epoch time domain basis to provide a parameterized voiced excitation function.

BRIEF DESCRIPTION OF DRAWING

The invention is pointed out with particularity in the appended claims. However, a more complete understanding of the present invention may be derived by referring to the detailed description and claims when considered in connection with the figures, wherein like reference characters refer to similar items throughout the figures, and:

Figure 1:
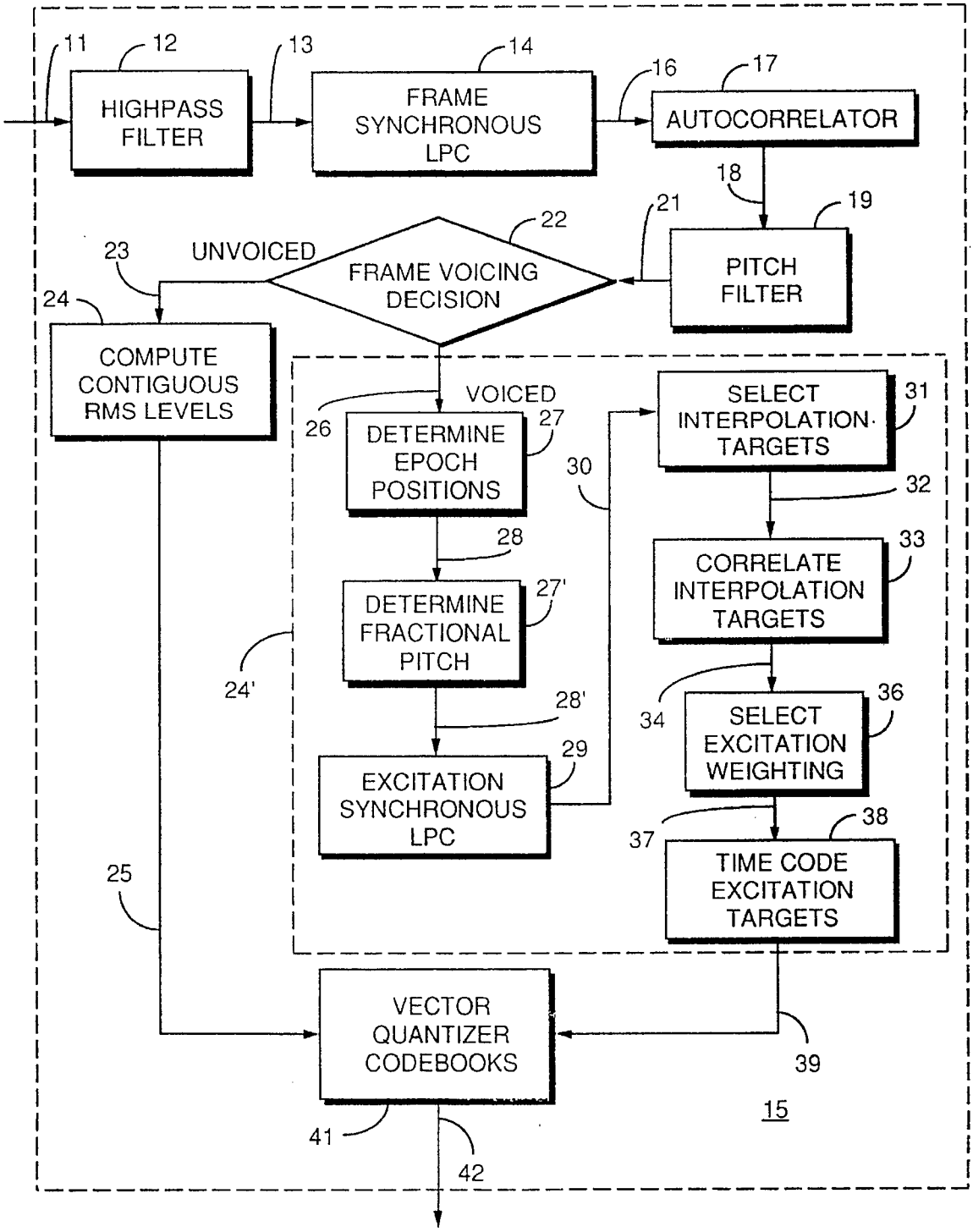
FIG. 1 is a simplified block diagram, in flow chart form, of a speech digitizer in a transmitter in accordance with the present invention.

The exemplification set out herein illustrates a preferred embodiment of the invention in one form thereof, and such exemplification is not intended to be construed as limiting in any mariner.

DETAILED DESCRIPTION OF THE DRAWING

FIG. 1 is a simplified block diagram, in flow chart form, of speech digitizer 15 in transmitter 10 in accordance with the present invention. Speech input 11 provides sampled input speech to highpass filter 12 As used herein, the terms "excitaion", "excitation function", "driving function" and "excitation waveform" have equivalent meanings and refer to a waveform provided by linear predictive coding apparatus as one of the output signals therefrom. As used herein, the terms "target", "excitation target" and "target epoch " have equivalent meanings and refer to an epoch selected first for characterization in an encoding apparatus and second for later interpolation in a decoding apparatus.

A primary component of voiced speech (e.g., "oo" in "smooth") is conveniently represented as a quasi-periodic, impulse-like driving function or excitation function having slowly varying envelope and period. This period is referred to as the "pitch period", or "epoch" comprising an individual impulse within the driving function. Conversely, the driving function associated with unvoiced speech (e.g., "ss" in "hiss") is largely random in nature and resembles shaped noise, i.e., noise having a time-varying envelope, where the envelope shape is the primary informat ion-carrying component.

The composite voiced/unvoiced driving waveform may be thought of as an input to a system transfer function whose output provides a resultant speech waveform. The composite driving waveform may be referred to as the "excitation function" for the human voice. Thorough, efficient characterization of the excitation function yields a better approximation to the unique attributes of an individual speaker, which attributes are poorly represented or ignored altogether in reduced bandwidth voice coding schemata to date (e.g., LPC10e).

In the arrangement according to the present invention, speech signals are supplied via input 11 to highpass filter 12. Highpass filter 12 is coupled to frame synchronous linear predictive coding (LPC) apparatus 14 via link 13. LPC apparatus 14 provides an excitation function via link 16 to autocorrelator 17. Autocorrelator 17 estimates $\tau$, the integer pitch period in samples of the quasi-periodic excitation waveform. The excitation function and the $\tau$ estimate are input via link 18 to pitch filter 19, which estimates excitation function structure associated with the input speech signal. Pitch filter 19 is well known in the art (see, for example, "Pitch Prediction Filters In Speech Coding", by R. P. Ramachandran and P. Kabal, in IEEE Transactions on Acoustics, Speech and Signal Processing,.vol. 37, no. 4, April 1989). The estimates for LPC prediction gain (from frame synchronous LPC apparatus 14), $\tau$ (from autocorrelator 17), pitch filter prediction gain (from pitch filter 19) and filter coefficient values (from pitch filter 19) are used in decision block 22 to determine whether input speech data represent voiced or unvoiced input speech data.

Unvoiced excitation data are coupled via link 23 to block 24, where contiguous RMS levels are computed. Signals representing these RMS levels are then coupled via link 25 to vector quantizer codebooks 41 having general composition and function which are well known in the art.

Typically, a 30 millisecond frame of unvoiced excitation comprising 240 samples is divided into 20 contiguous time slots. While this example is provided in terms of analysis of single frame, it will be appreciated by those of skill in the art that larger or smaller blocks of information may be characterized in this fashion with appropriate results. The excitation signal occurring during each time slot is analyzed and characterized by a representative level, conveniently realized as an RMS (root-mean-square) level. This effective technique for the transmission of unvoiced frame composition offers a level of computational simplicity not possible with much more elaborate frequency-domain fast Fourier transform (FFT) methods without significant compromise in quality of the reconstructed unvoiced speech signals.

Voiced excitation data are time-domain processed in block 24', where speech characteristics are analyzed on a "per epoch" basis. These data are coupled via link 26 to block 27, wherein epoch positions are determined. Once the epoch positions are located within the excitation waveform, a refined estimate of the integer value $\tau$ may be determined. For N epoch positions within a frame of speech, the N–1 individual epoch periods may be averaged to provide a revised $\tau$ estimate including a fractional portion, also known as "fractional pitch". At the receiver, the epoch positions are derived from the prior target position and $\tau$ by "stepping" forward from the prior target position by the appropriate $\tau$ value. The fractional portion of $\tau$ prevents significant errors from developing during long periods of voiced speech. When using only integer $\tau$ values to determine epoch positions at the receiver, the derived positions can incur significant "walking error" (cumulative error). Use of fractional $\tau$ values effectively eliminates positioning errors inherent in systems employing only integer $\tau$ values.

Following epoch position determination, data are coupled via link 28 to block 27', where fractional pitch is determined. Data are then coupled via link 28' to block 29, wherein excitation synchronous LPC analysis is performed on the input speech given the epoch positioning data (from block 27), both provided via link 28'. This process provides revised LPC coefficients and excitation function which are coupled via link 30 to block 31, wherein a single excitation epoch is chosen in each frame as an interpolation target. The excitation synchronous LPC coefficients (from LPC apparatus 29), corresponding to the optimum target excitation function are chosen as coefficient interpolation targets. Both the statistically weighted excitation function and the associated LPC coefficients are utilized via interpolation to regenerate elided information at the receiver (discussed in connection with FIG. 4, infra). As only one set of LPC coefficients and one excitation epoch are encoded at the transmitter, the remaining excitation waveform and epoch-synchronous coefficients must be derived from the chosen "targets" at the receiver. Linear interpolation between transmitted targets has been used with success to regenerate the missing information, although other non-linear schemata are also useful. Thus, only a single excitation epoch is time-encoded per frame at the transmitter, with the intervening epochs filled in by interpolation at the receiver.

Excitation targets may be selected in a closed-loop fashion, whereby the envelope formed by the candidate target excitation epochs in adjacent frames is compared against the envelope of the original excitation. The candidate target excitation epoch resulting in the lowest or minimum interpolated envelope error is chosen as the interpolation target for the frame. This closed-loop technique for target selection reduces envelope errors, such as those encountered in interpolation across envelope "nulls" or (inappropriate) interpolation causing gaps to appear in the resultant envelope. Such errors may often occur if excitation target selection is made in a random fashion ignoring the envelope appropriate to the affected excitation target.

The chosen epochs are coupled via link 32 to block 33, wherein chosen epochs in adjacent frames are cross-correlated in order to determine an optimum epoch starting index and enhance the effectiveness of the interpolation process. By correlating the two targets, the maximum correlation index shift may be introduced as a positioning offset prior to interpolation. This offset improves on the standard interpolation scheme by forcing the "phase" of the two targets to coincide. Failure to perform this correlation procedure prior to interpolation often leads to significant reconstructed excitation envelope error at the receiver.

For example, artificial "hulling" of the reconstructed envelope may occur in such cases, leading to significant perceptual artifacts in the reconstructed speech signals. By introducing a maximum correlation offset prior to interpolation, the envelope regenerated by the interpolation process more closely resembles the original excitation waveform (derived from input speech). This correlation procedure has been shown here as implemented at the transmitter, however, the technique may alternatively be implemented at the receiver with similar beneficial results.

The correlated interpolation targets (block 33), coupled via link 34, are weighted in a process wherein "statistical" excitation weighting is selected (block 36) appropriate to the speech samples being processed.

Figure 2:
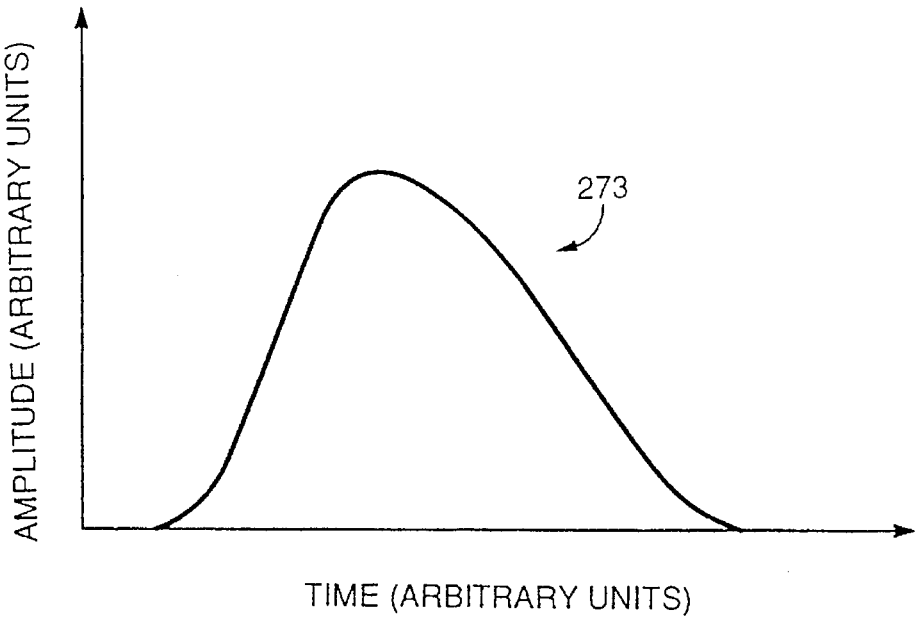
FIG. 2 is a graph including a trace of a Rayleigh type excitation weighting function suitable for weighting excitation associated with male speech.

Typically, a Rayleigh shaped time-domain excitation function weighting function is appropriate for excitation associated with male speech. Such functions are often represented as being of the form:

$$y\alpha 2((x-a)/b)e^{-(x-a)^2/b}, x>a \tag{1a}$$

and $$y=0, x<a, \tag{1b}$$

where a is the ×intercept and $x=a+(b/2)^{0.5}$ defines the weighting peak position. Alternatively, this type of weighting is usefully represented as a raised cosine function having a left-shifted peak or as a type of chi-squared distribution. FIG. 2 is a graph including trace 273 of a representative Rayleigh type excitation weighting function suitable for weighting excitation associated with male speech.

This allows circa 20 samples per chosen target epoch (corresponding to a typical epoch length of 80 samples) to provide high quality reconstructed speech signals, although greater or lesser numbers of samples may be employed as appropriate.

Figure 3:
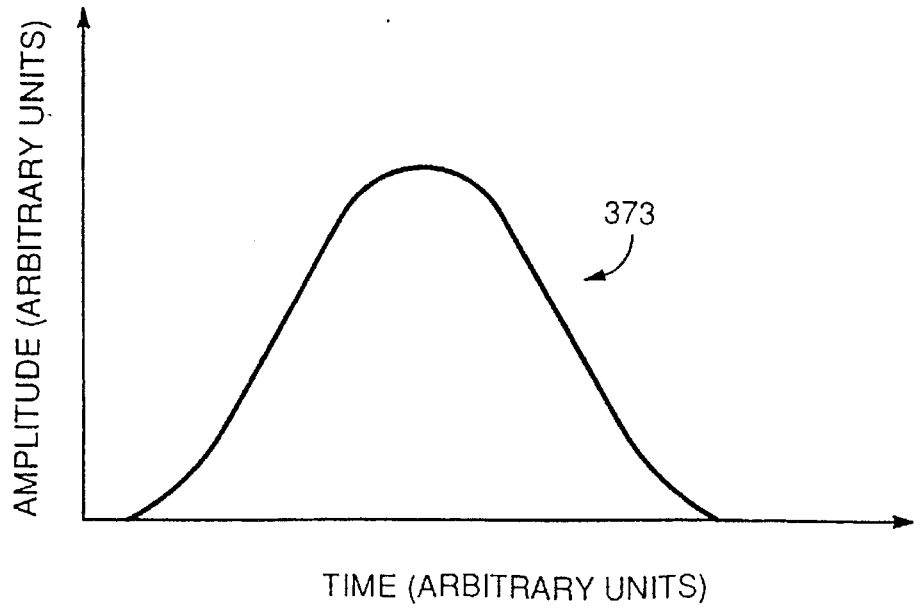
FIG. 3 is a graph including a trace of a Gaussian type excitation weighting function suitable for weighting excitation associated with female speech.

A smaller number of samples (e.g., circa 10 samples, corresponding to a typical epoch length of 35) is often adequate for representing excitation associated with higher pitch female speech. An appropriate excitation weighting function for female speech resembles more of a Gaussian shape. Such functions are often represented as being of the form:

$$y\alpha e^{-(x-\beta)^2/2\sigma^2}, \tag{2}$$

where $\beta$ represents the mean and $\sigma$ represents the standard deviation as is well known in the art. Alternatively, this type of weighting is usefully represented as a raised cosine function. FIG. 3 is a graph including trace 373 of a representative Gaussian type excitation weighting function suitable for weighting excitation associated with female speech.

Only one excitation epoch is time-encoded per frame of data, and only a small number of characterizing samples are required to adequately represent the salient features of the excitation epoch. By applying an appropriate weighting function about the target excitation function impulse, the speaker-dependent characteristics of the excitation are largely maintained and hence the reconstructed speech will more accurately represent the tenor, character and data-conveying nuances of the original input speech. Selection of an appropriate weighting function reduces the required data for transmission while maintaining the major envelope or shape characteristics of an individual excitation epoch.

Since only one excitation epoch, compressed to a few characterizing samples, is utilized in each frame, the data rate (bandwidth) required to transmit the resultant digitally-encoded speech is reduced. High quality speech is produced at the receiver even though transmission bandwidth requirements are reduced. As with the unvoiced characterization process (block 24), the voiced time-domain weighting/decoding procedure provides significant computational savings relative to frequency-domain techniques while providing significant fidelity advantages over simpler or less sophisticated techniques which fail to model the excitation characteristics as carefully as is done in the present invention.

Following selection of an appropriate excitation function weighting function (block 36), the weighting function and data are coupled via link 37 to block 38, wherein the excitation targets are time coded, i.e., the weighting is applied to the target. The resultant data are passed to vector quantizer codebooks 41 via link 39.

Data representing unvoiced (link 25) and voiced (link 39) speech are coded using vector quantizer codebooks 41 and coded digital output signals are coupled to transmission media, encryption apparatus or the like via link 42.

Figure 4:
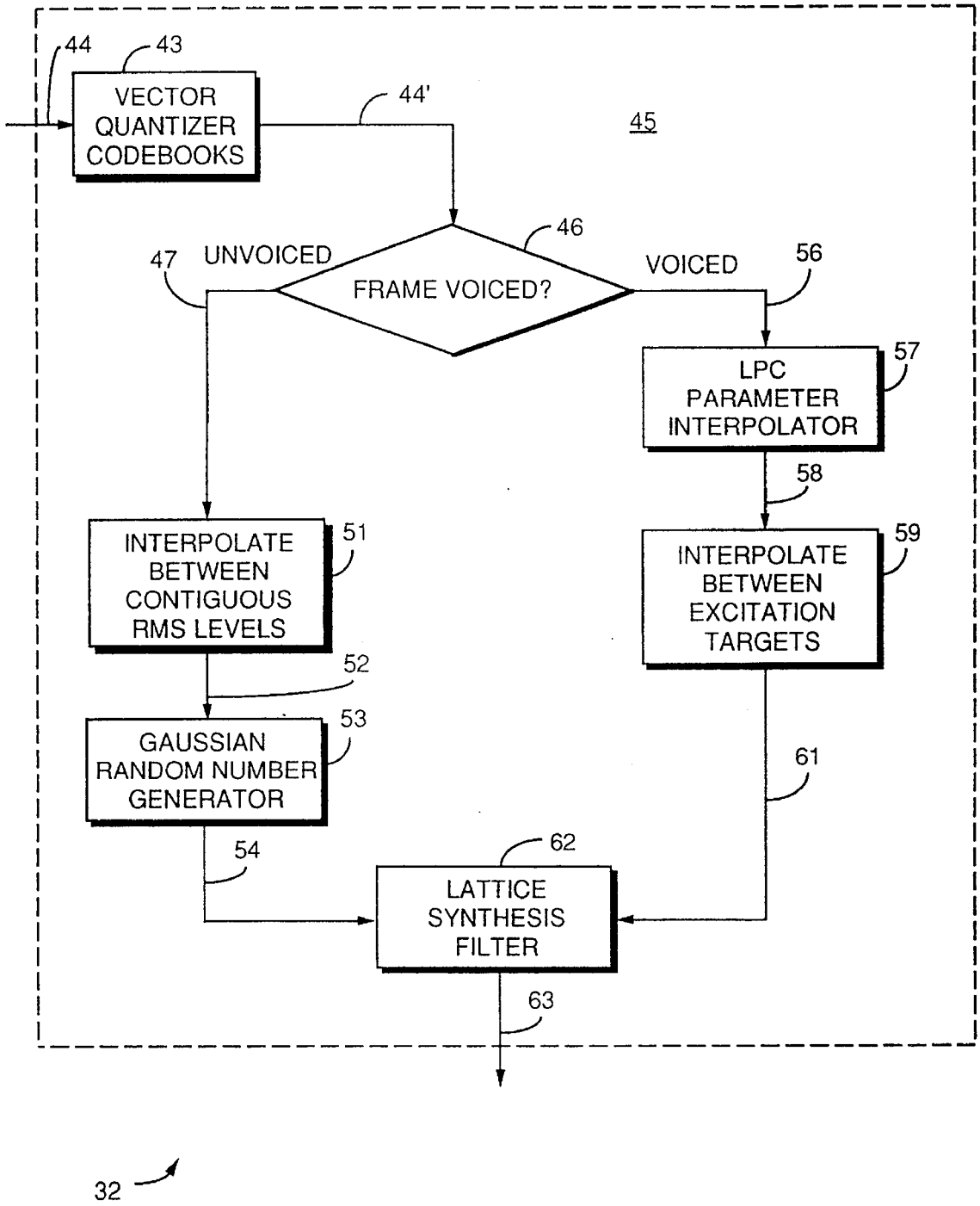
FIG. 4 is a simplified block diagram, in flow chart form, of a speech synthesizer in a receiver for digital data provided by an apparatus such as the transmitter of FIG. 1.

FIG. 4 is a simplified block diagram, in flow chart form, of speech synthesizer 45 in receiver 32 for digital data provided by an apparatus such as transmitter 10 of FIG. 1. Receiver 32 has digital input 44 coupling digital data representing speech signals to vector quantizer codebooks 43 from external apparatus (not shown) providing decryption of encrypted received data, demodulation of received RF or optical data, interface to public switched telephone systems and/or the like. Decoded data from vector quantizer codebooks 43 are coupled via link 44' to decision block 46, which determines whether vector quantized data represent a voiced frame or an unvoiced frame.

When vector quantized data from link 44' represent an unvoiced frame, these data are coupled via link 47 to block 51. Block 51 linearly interpolates between the contiguous RMS levels to regenerate the unvoiced excitation envelope and the result is applied to amplitude modulate a Gaussian random number generator 53 via link 52 to re-create the unvoiced excitation signal. This unvoiced excitation function is coupled via link 54 to lattice synthesis filter 62. Lattice synthesis filters such as 62 are common in the art and are described, for example, in Digital Processing of Speech Signals, by L. R. Rabiner and R. W. Schafer (Prentice Hall, Englewood Cliffs, N.J. 1978).

When vector quantized data (link 44') represent voiced input speech, these data are coupled to LPC parameter interpolator 57 via link 56, which interpolates the missing LPC reflection coefficients (which were not transmitted in order to reduce transmission bandwidth requirements). Linear interpolation is performed (block 59) from the statistically weighted target excitation epoch in the previous frame to the statistically weighted target excitation epoch in the current frame, thus recreating the excitation waveform discarded during the encoding process (i.e., in speech digitizer 15 of transmitter 10, FIG. 1). Due to relatively slow variations of excitation envelope and pitch within a frame, these interpolated, concatenated excitation epochs mimic characteristics of the original excitation.

The reconstructed excitation waveform and LPC coefficients from LPC parameter interpolator 57 and interpolate between excitation targets 59 are coupled via link 61 to lattice synthesis filter 62.

For both voiced and unvoiced frames, lattice synthesis filter 62 synthesizes high-quality output speech coupled to external apparatus (e.g., speaker, earphone, etc., not shown in FIG. 4) closely resembling the input speech signal and maintaining the unique speaker-dependent attributes of the original input speech signal whilst simultaneous requiring reduced bandwidth (e.g., 2400 bits per second or baud).

Figure 5:
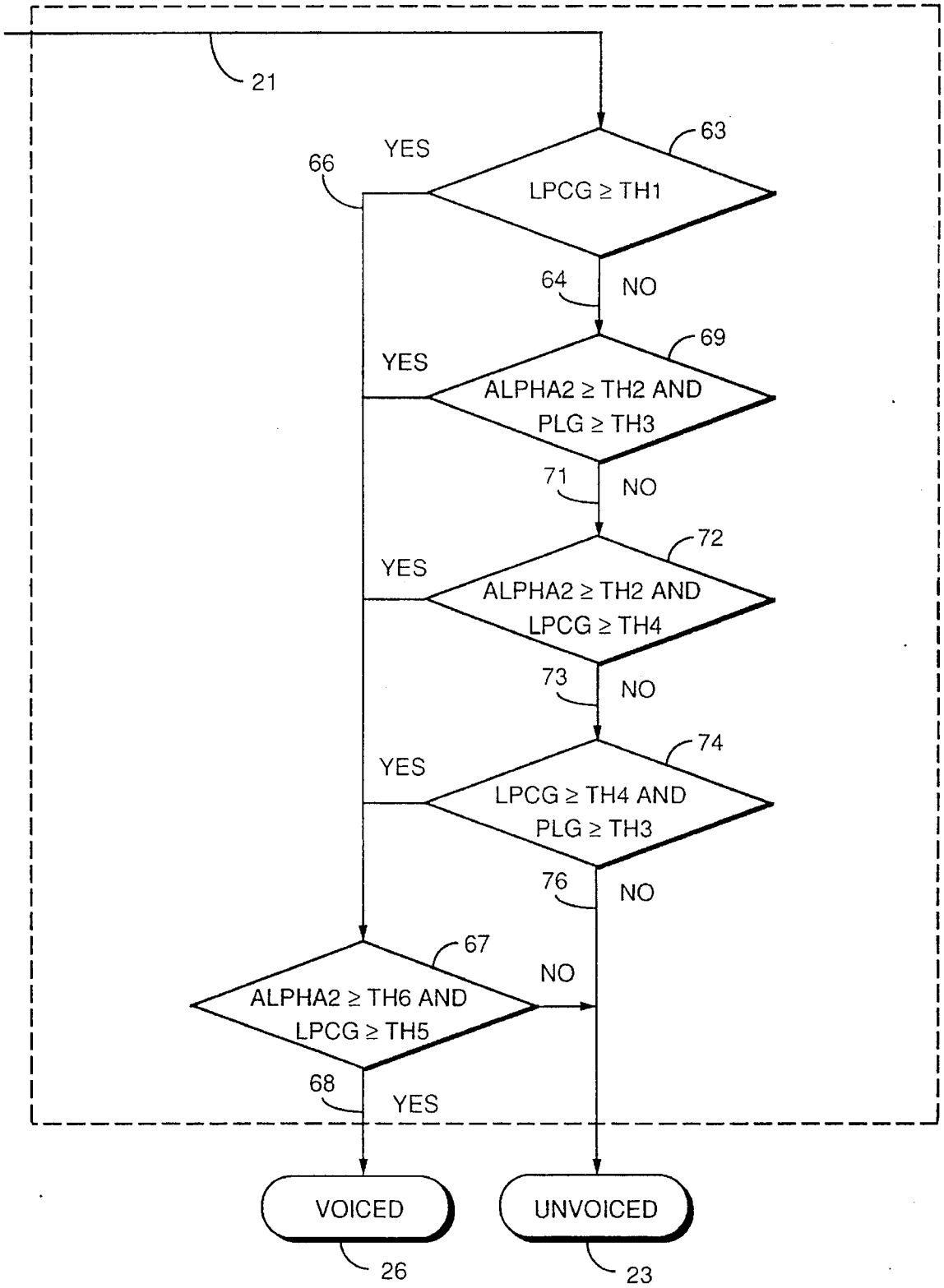
FIG. 5 is a more detailed block diagram, in flow chart form, showing a decision tree apparatus for determining voicing in the transmitter of FIG. 1.

FIG. 5 is a more detailed block diagram, in flow chart form, showing decision tree apparatus 22 for determining voicing in transmitter 10 of FIG. 1. Decision tree apparatus 22 receives input data via link 21 which are coupled to decision block 63 and which are summarized in Table I below together with a representative series of threshold values. It will be appreciated by those of skill in the art to which the present invention pertains that the values provided in Table I are represent and that other combinations of values also provide acceptable performance.

When LPCG≧TH1, (i.e., LPC gain coefficient exceeds a first voiced threshold) data are coupled to decision block 67 via link 66; otherwise, data are coupled to decision block 69 via link 64. LPCG is indicative of how well (or poorly) the predicted speech approximates the original speech and can be formed by the inverse of the ratio of the RMS magnitude of the excitation to the RMS magnitude of the original speech waveform.

TABLE I

Symbols and definitions for parameters used in voicing decision and source thereof or value therefor.

| Symbol | Quantity | Source/value |
|---|---|---|
| LPCG | LPC prediction gain | Frame synchronous LPC 14 |
| PLG | Filter prediction gain (pitch gain) | Pitch filter 19 |
| ALPHA2 | Second filter coefficient | Pitch filter 19 |
| TH1 | LPCG absolute voiced threshold | 4.1 |
| TH2 | ALPHA2 voiced threshold | 0.2 |
| TH3 | PLG voiced threshold | 1.06 |
| TH4 | LPCG voiced threshold | 2.45 |
| TH5 | LPCG unvoiced threshold | 1.175 |
| TH6 | ALPHA2 unvoiced threshold | 0.01 |

Decision block 69 tests whether ALPHA2≧TH2 (i.e., whether the second filter coefficient is greater than a second voiced threshold) and also whether PLG≧TH3 (i.e., filter prediction gain exceeds a third voiced threshold). ALPHA2 was empirically determined to be related to voicedness. Pitch gain PLG is a measure of how well the coefficients from pitch filter 19 predict the excitation function and is calculated in a fashion similar to LPCG.

When both conditions tested in decision block 69 are true, data are coupled to decision block 67 via link 66; otherwise, data are coupled to decision block 72 via link 71. Decision block 72 tests whether ALPHA2≧TH2 and also whether LPCG≧TH4 (i.e., LPC gain coefficient exceeds a fourth voiced threshold). When both conditions are true, data are coupled to decision block 67 via link 66; otherwise, data are coupled to decision block 74 via link 73. Decision block 74 tests whether PLG≧TH3 and also whether LPCG≧TH4. When both conditions are true, data are coupled to decision block 67 via link 66; otherwise, the input speech signal is classed as being "unvoiced" and data are coupled to output 23 (see also FIG. 1) via link 76.

Decision block 67 tests whether LPCG≧TH5 (i.e., LPC gain coefficient exceeds a first unvoiced threshold) and also whether ALPHA2≧TH6 (i.e., second filter coefficient exceeds a sixth unvoiced threshold). When both conditions are true, the input speech signal is classed as being "voiced" and data are coupled to output 26 (see also FIG. 1) via link 68; otherwise, the input speech signal is classed as being "unvoiced" and data are coupled to output 23 via link 76.

EXAMPLE

Figure 6:
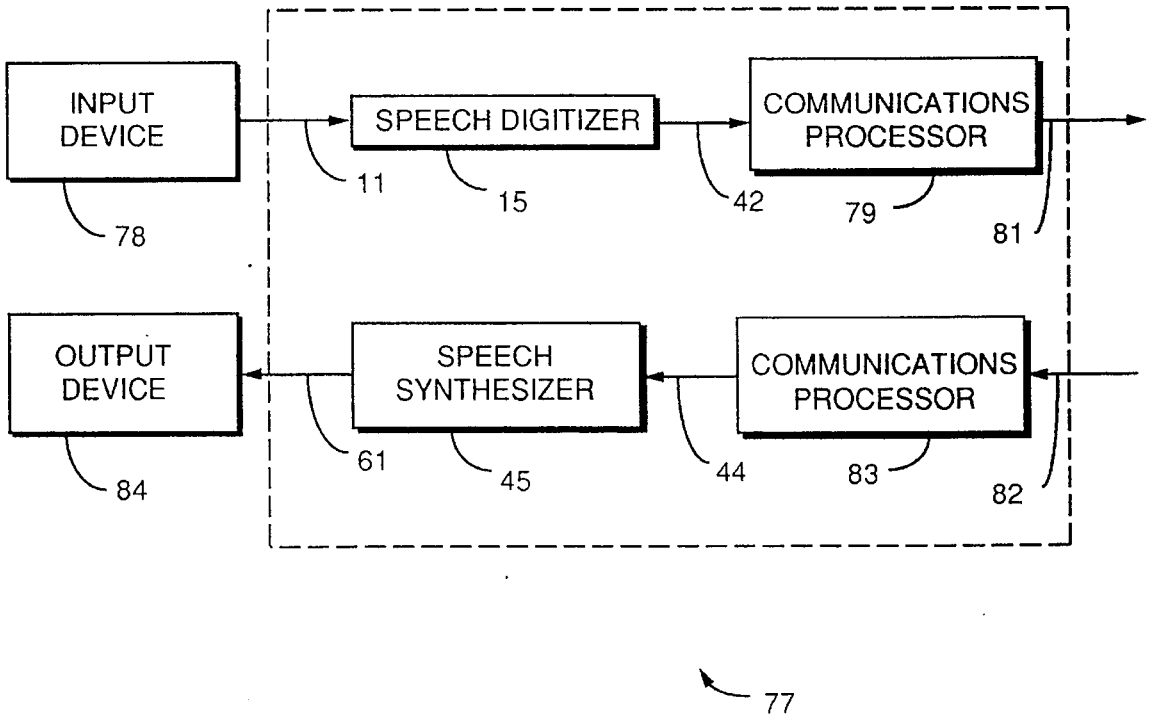
FIG. 6 is a highly simplified block diagram of a voice communication apparatus employing the speech digitizer of FIG. 1 and the speech synthesizer of FIG. 4 in accordance with the present invention.

FIG. 6 is a highly simplified block diagram of voice communication apparatus 77 employing speech digitizer 15 (FIG. 1) and speech synthesizer 45 (FIG. 4) in accordance with the present invention. Speech digitizer 15 and speech synthesizer 45 may be implemented as assembly language programs in digital signal processors such as Type DSP56001, Type DSP56002 or Type DSP96002 integrated circuits available from Motorola, Inc. of Phoenix, Ariz.

Memory circuits, etc., ancillary to the digital signal processing integrated circuits, may also be required, as is well known in the art.

Voice communications apparatus 77 includes speech input device 78 coupled to speech input 11. Speech input device 78 may be a microphone or a handset microphone, for example, or may be coupled to telephone or radio apparatus or a memory device (not shown) or any other source of speech data. Input speech from speech input 11 is digitized by speech digitizer 15 as described in FIGS. 1 and 3 and associated text. Digitized speech is output from speech digitizer 15 via output 42.

Voice communication apparatus 77 may include communications processor 79 coupled to output 42 for performing additional functions such as dialing, speakerphone multiplexing, modulation, coupling signals to telephony or radio networks, facsimile transmission, encryption of digital signals (e.g., digitized speech from output 42), data compression,, billing functions and/or the like, as is well known in the art, to provide an output signal via link 81.

Similarly, communications processor 83 receives incoming signals via link 82 and provides appropriate coupling, speakerphone multiplexing, demodulation, decryption, facsimile reception, data decompression, billing functions and/or the like, as is well known in the art.

Digital signals representing speech are coupled from communications processor 83 to speech synthesizer 45 via link 44. Speech synthesizer 45 provides electrical signals corresponding to speech signals to output device 84 via link 61. Output device 84 may be a speaker, handset receiver element or any other device capable of accommodating such signals.

It will be appreciated that communications processors 79, 83 need not be physically distinct processors but rather that the functions fulfilled by communications processors 79, 83 may be executed by the same apparatus providing speech digitizer 15 and/or speech synthesizer 45, for example.

It will be appreciated that, in an embodiment of the present invention, links 81, 82 may be a common bidirectional data link. It will be appreciated that in an embodiment of the present invention, communications processors 79, 83 may be a common processor and/or may comprise a link to apparatus for storing or subsequent processing of digital data representing speech or speech and other signals, e.g., television, camcorder, etc.

Voice communication apparatus 77 thus provides a new apparatus and method for digital encoding, transmission and decoding of speech signals allowing high fidelity reproduction of voice signals together with reduced bandwidth requirements for a given fidelity level. The unique excitation characterization and reconstruction techniques employed in this invention allow significant bandwidth savings and provide digital speech quality previously only achievable in digital systems having much higher data rates.

For example, selecting an epoch and preferably an optimum epoch in the sense that interpolated envelope error is reduced or minimized, weighting the selected epoch with an appropriate function to reduce the amount of information necessary and the target correlation provide substantial benefits and advantages in the encoding process, while the interpolation from frame to frame in the receiver allows high fidelity reconstruction of the input speech signal from the encoded signal. Further, characterizing unvoiced excitation representing speech by dividing a region, set or sample of excitation into a series of contiguous windows and measuring an RMS signal level for each of the contiguous windows comprises substantial reduction in complexity of signal processing.

Thus, an excitation synchronous time encoding vocoder and method have been described which overcome specific problems and accomplish certain advantages relative to prior art methods and mechanisms. The improvements over known technology are significant. The expense, complexities, and high power consumption of previous approaches are avoided. Similarly, improved fidelity is provided without sacrifice of achievable data rate.

The foregoing description of the specific embodiments will so fully reveal the general nature of the invention that others can, by applying current knowledge, readily modify and/or adapt for various applications such specific embodiments without departing from the generic concept, and therefore such adaptations and modifications should and are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A method for excitation synchronous time decoding of digital signals to provide speech signals, said method comprising steps of:

providing an input digital signal representing speech;

determining when the input digital signal represents voiced speech, and, when the input digital signal represents voiced speech, performing steps of:

deriving linear predictive coding parameters from said input digital signal;

interpolating linear predictive coding parameters derived from said input digital signal to provide interpolated linear predictive coding parameters;

reconstructing a voiced excitation function from said interpolated linear predictive coding parameters to provide a reconstructed voiced excitation function; and synthesizing speech from the reconstructed voiced excitation function by providing the reconstructed voiced excitation function to a lattice synthesis filter.

2. A method as claimed in claim 1, wherein reconstructing a voiced excitation function further comprises a step of interpolating between target excitation functions in adjacent frames.

3. A method as claimed in claim 1, wherein said step of determining when the input digital signal represents voiced speech includes, when the input digital data represent unvoiced speech, steps of:

decoding a series of contiguous root-mean-square (RMS) amplitudes;

interpolating between the contiguous RMS amplitudes to regenerate an unvoiced envelope;

modulating a noise generator with the regenerated envelope to provide a reconstructed unvoiced excitation function; and synthesizing unvoiced speech from the reconstructed unvoiced excitation function.

4. A method as claimed in claim 3, wherein modulating a noise generator includes modulating a Gaussian random number generator.

5. An apparatus for excitation synchronous time decoding of digital signals to provide speech signals, said apparatus comprising:

an input for receiving digital signals representing encoded speech;

encoding means coupled to said input, said encoding means for providing quantized signals from said digital signals;

frame voicing decision means coupled to said encoding means, said frame voicing decision means for determining when said quantized signals represent voiced speech and when said quantized signals represent unvoiced speech;

means for interpolating between contiguous signal levels representative of unvoiced excitation coupled to said frame voicing decision means;

a random noise generator coupled to said interpolating means, said random noise generator for providing noise signals modulated to a level determined by said interpolating means; and lattice synthesis filter means coupled to said random noise generator for synthesizing unvoiced speech from said modulated noise signals.

6. An apparatus as claimed in claim 5, wherein said random noise generator is a Gaussian random number generator.

7. An apparatus as claimed in claim 5, further comprising:

linear predictive coding (LPC) parameter interpolation means coupled to said frame voicing decision means, said LPC parameter interpolation means for interpolating between successive LPC parameters provided in said quantized signals when said quantized signals represent voiced speech to provide interpolated LPC parameters; and lattice synthesis filter means coupled to said LPC parameter interpolation means for synthesizing voiced speech from said quantized signals and said interpolated LPC parameters.

8. An apparatus as claimed in claim 7, further comprising means for interpolating successive excitation functions intercalated between target excitation functions, said means for interpolating successive excitation functions having an input coupled to said LPC parameter interpolation means and having an output coupled to said lattice synthesis filter means, said means for interpolating between target excitation functions for interpolating successive excitation functions in epochs between a first target epoch in a first frame and a second target epoch in a second frame adjacent said first frame, wherein said lattice synthesis filter means synthesizes voiced speech from said interpolated LPC parameters and said interpolated successive excitation functions.

9. An apparatus as claimed in claim 5, wherein said contiguous signal levels representative of unvoiced excitation comprise contiguous root-mean-square levels representative of unvoiced excitation.

10. A communications apparatus including:

an input for receiving input speech signals;

a speech digitizer coupled to said input for digitally encoding said input speech signals;

an output for transmitting said digitally encoded input speech signals, said output coupled to said speech digitizer;

a digital input for receiving digitally encoded speech signals;

speech synthesizer means coupled to said digital input for synthesizing speech signals from said digitally encoded speech signals, wherein said speech synthesizer means further comprises:

frame voicing decision means coupled to vector quantizer codebooks, said frame voicing decision means for determining when quantized signals from said vector quantizer codebooks represent voiced speech and when said quantized signals represent unvoiced speech;

means for interpolating between contiguous signal levels representative of unvoiced excitation coupled to said frame voicing decision means; and a random noise generator coupled to said interpolating means, said random noise generator for providing noise signals modulated to a level determined by said interpolating means; and output means coupled to said random noise generator for synthesizing unvoiced speech from said modulated noise signals.

11. A communications apparatus as claimed in claim 10, wherein said random noise generator is a Gaussian random number generator.

12. An apparatus for excitation synchronous time decoding of digital signals to provide speech signals, said apparatus comprising:

an input for receiving digital signals representing encoded speech;

an encoder coupled to said input, said encoder for providing quantized signals from said digital signals;

a frame voicing decision apparatus coupled to said encoder for determining when said quantized signals represent voiced speech and when said quantized signals represent unvoiced speech;

a first interpolator coupled to said frame voicing decision apparatus, said first interpolator for interpolating between contiguous root-mean-square signal levels representative of unvoiced excitation;

a random noise generator coupled to said first interpolater, said random noise generator for providing noise signals modulated to a level determined by said first interpolater; and a lattice synthesis filter coupled to said random noise generator for synthesizing unvoiced speech from said modulated noise signals.

13. An apparatus as claimed in claim 12, wherein said random noise generator is a Gaussian random number generator.

14. An apparatus as claimed in claim 13, further comprising:

a second interpolater coupled to said frame voicing decision apparatus, said second interpolater for interpolating between successive LPC parameters provided in said quantized signals when said quantized signals represent voiced speech to provide interpolated LPC parameters; and wherein said lattice synthesis filter is coupled to said second interpolater for synthesizing voiced speech from said quantized signals and said interpolated LPC parameters.

15. An apparatus as claimed in claim 14, further comprising a third interpolator for interpolating successive excitation functions intercalated between target excitation functions, said third interpolater having an input coupled to said second interpolater and having an output coupled to said lattice synthesis filter, said third interpolater for interpolating successive excitation functions in epochs between a first target epoch in a first frame and a second target epoch in a second frame adjacent said first frame, wherein said lattice synthesis filter synthesizes voiced speech from said interpolated LPC parameters and said interpolated successive excitation functions.

16. An apparatus for excitation synchronous time decoding of digital signals to provide speech signals, said apparatus comprising:

an input for receiving digital signals representing encoded speech;

an encoder coupled to said input, said encoder for providing quantized signals from said digital signals;

a frame voicing decision apparatus coupled to said encoder, said frame voicing decision apparatus for determining when said quantized signals represent voiced speech and when said quantized signals represent unvoiced speech;

a first interpolater coupled to said frame voicing decision apparatus, said first interpolater for interpolating between successive LPC parameters provided in said quantized signals when said quantized signals represent voiced speech to provide interpolated LPC parameters; and a lattice synthesis filter coupled to said first interpolater for synthesizing voiced speech from said quantized signals and said interpolated LPC parameters.

17. An apparatus as claimed in claim 16, further comprising:

a second interpolater for interpolating between contiguous signal levels representative of unvoiced excitation coupled to said frame voicing decision apparatus;

a random noise generator coupled to said second interpolater, said random noise generator for providing noise signals modulated to a level determined by said second interpolater; and wherein said lattice synthesis filter is coupled to said random noise generator for synthesizing unvoiced speech from said modulated noise signals.

18. An apparatus as claimed in claim 17, further comprising a third interpolater for interpolating successive excitation functions intercalated between target excitation functions, said third interpolater having an input coupled to said second interpolater and having an output coupled to said lattice synthesis filter, said third interpolater for interpolating successive excitation functions in epochs between a first target epoch in a first frame and a second target epoch in a second frame adjacent said first frame, wherein said lattice synthesis filter synthesizes voiced speech from said interpolated LPC parameters and said interpolated successive excitation functions.

19. An apparatus as claimed in claim 17, wherein said contiguous signal levels representative of unvoiced excitation comprise contiguous root-mean-square levels representative of unvoiced excitation.

20. An apparatus as claimed in claim 17, wherein said random noise generator is a Gaussian random number generator.

* * * * *